US007828555B1

(12) United States Patent
Huang

(10) Patent No.: US 7,828,555 B1
(45) Date of Patent: Nov. 9, 2010

(54) POWER PLUG WITH A ROTARY BODY INCLUDING A PIVOTING PORTION

(75) Inventor: Jing-Xiao Huang, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 12/648,263

(22) Filed: Dec. 28, 2009

(30) Foreign Application Priority Data

May 27, 2009 (TW) ..... 98209477 U

(51) Int. Cl.
*H01R 39/00* (2006.01)
*H01R 41/00* (2006.01)

(52) U.S. Cl. ..... 439/6

(58) Field of Classification Search ..... 439/6, 439/8, 11, 13, 23, 446, 456
See application file for complete search history.

(56) References Cited

U.S. PATENT DOCUMENTS 1,981,854 A * 11/1934 Comiskey ..... 439/6
5,735,707 A * 4/1998 O'Groske et al. ..... 439/446
6,520,787 B1 * 2/2003 Lott ..... 439/218
6,559,383 B1 * 5/2003 Martin ..... 174/84 R
6,695,620 B1 * 2/2004 Huang ..... 439/11
6,780,034 B2 * 8/2004 Shiroshita et al. ..... 439/174
7,168,969 B1 * 1/2007 Wang ..... 439/173
7,549,877 B1 * 6/2009 Vista et al. ..... 439/172
7,614,903 B1 * 11/2009 Huang ..... 439/446
2007/0155191 A1 * 7/2007 Buller et al. ..... 439/8

* cited by examiner

*Primary Examiner*—Chandrika Prasad
(74) *Attorney, Agent, or Firm*—WPAT, P.C.; Anthony King

(57) ABSTRACT

A power plug connector for connecting with a wire includes a shell with a receiving cavity being opened through a rear end thereof, a pin assembly fastened in a front of the shell and stretching forward beyond the shell, and a rotating body including a pivoting portion rotatably pivoted in the receiving cavity of the shell. The rotating body defines a perforation penetrating through the pivoting portion. One end of the wire is passed through the perforation of the rotating body and then electrically connected with the pin assembly. The rotating body can rotate in the receiving cavity of the shell so that can avoid the wire twisting and fracturing in use and is further easy to arrange the wire in order. Therefore, it prolongs the use life of the power plug connector.

6 Claims, 3 Drawing Sheets

POWER PLUG WITH A ROTARY BODY INCLUDING A PIVOTING PORTION

BACKGROUND OF THE INVENTION

1. Field of the Invention

The present invention generally relates to a power plug connector, and more particularly to a rotatable power plug connector.

2. The Related Art

With the development of electronic technology, more and more electronic products are widely used in daily life. The electronic product gains power by means of a plug being inserted to a corresponding outlet, wherein the plug is connected with the electronic product by a wire. However, the wire is often twisted at the junction of the wire and the plug due to a fixed connection between the wire and the plug. As a result, the wire is apt to be fractured to result in a power failure or a short circuit. Furthermore, the wire has a disorderly arrangement due to the twist and is difficult to be put in order.

SUMMARY OF THE INVENTION

An object of the present invention is to provide a power plug connector for connecting with a wire. The power plug connector includes a shell with a receiving cavity being opened through a rear end thereof, a pin assembly fastened in a front of the shell and stretching forward beyond the shell, and a rotating body including a pivoting portion rotatably pivoted in the receiving cavity of the shell. The rotating body defines a perforation penetrating through the pivoting portion. One end of the wire is passed through the perforation of the rotating body and then electrically connected with the pin assembly.

As described above, the rotating body of the power plug connector according to the present invention can rotate in the receiving cavity of the shell so that can avoid the wire twisting and fracturing in use and is further easy to arrange the wire in order. Therefore, it prolongs the use life of the power plug connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
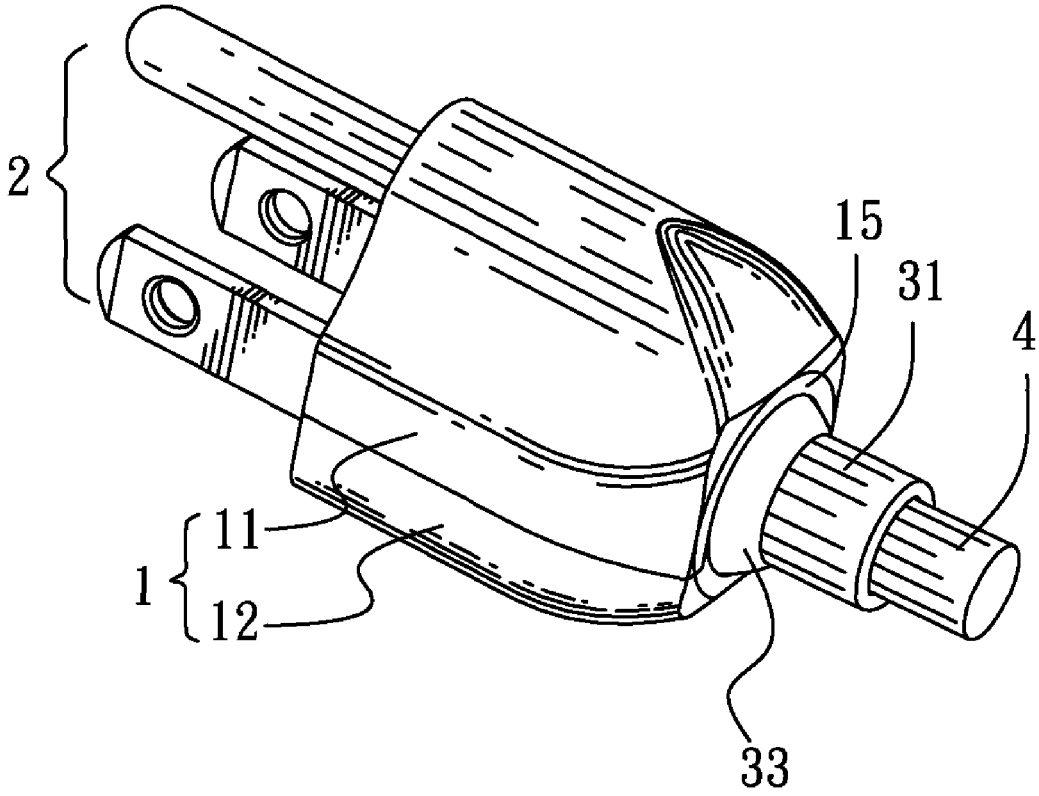
FIG. 1 is a perspective view of a power plug connector in accordance with the present invention.
Figure 2:
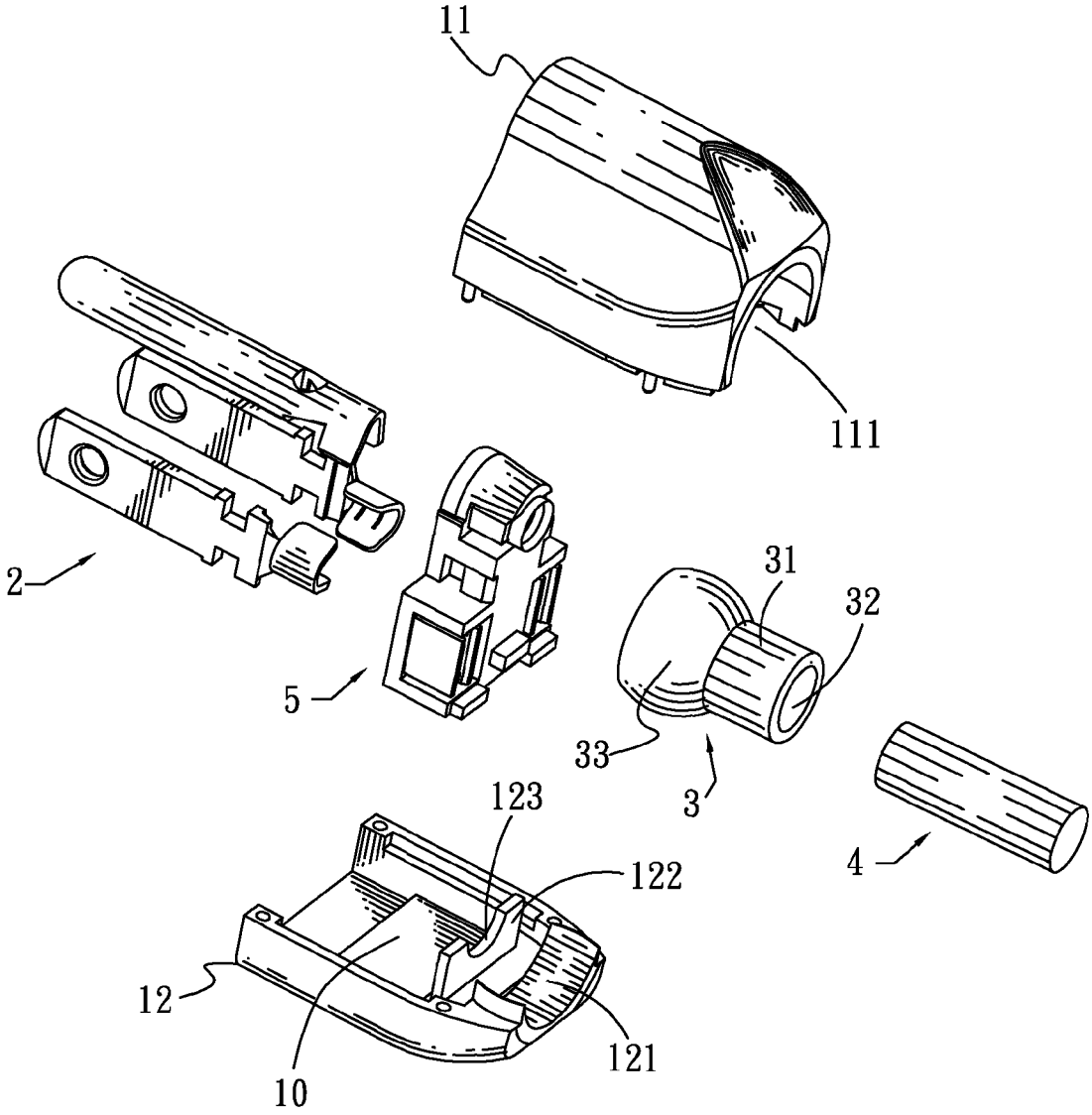
FIG. 2 is an exploded perspective view of the power plug connector of FIG. 1.

With reference to FIG. 1 and FIG. 2, a power plug connector according to the present invention includes a shell 1, a pin assembly 2, a fastening body 5, a rotating body 3 and a wire 4.

Figure 3:
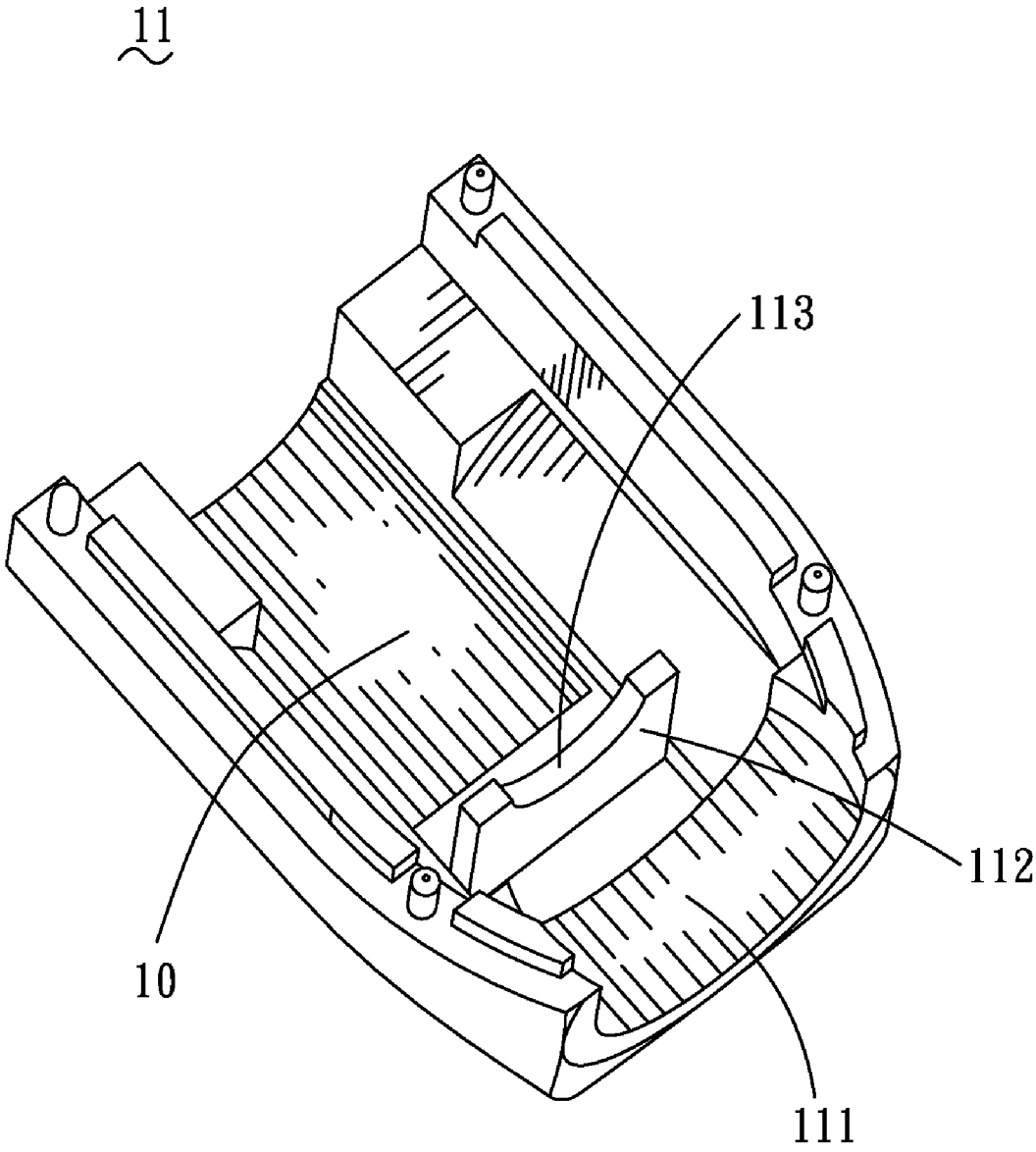
FIG. 3 is a perspective view of an upper half-shell of the power plug connector of FIG. 1.

Referring to FIGS. 1-3, the shell 1 includes an upper half-shell 11 and a lower half-shell 12 mated with each other to define a receiving chamber 10 therebetween. The receiving chamber 10 has a front end opened freely, and a middle of a rear end of the receiving chamber 10 further penetrates rearward through the shell 1 to form a receiving cavity 15 which has a gradually increasing diameter from two ends to a middle along a axis thereof and includes an upper half-cavity 111 opened through a rear end of the upper half-shell 11 and a lower half-cavity 121 opened through a rear end of the lower half-shell 12 to mate with the upper half-cavity 111. The shell 1 further defines a clipping fillister (not labeled) in the receiving chamber 10 to face the receiving cavity 15. The clipping fillister include a semi-circular upper clipping fillister 113 and a semi-circular lower clipping fillister 123. An inside of the upper half-shell 11 protrudes downward to form an upper fastening frame 112 traversed in front of the upper half-cavity 111 with the semi-circular upper clipping fillister 113 opened in a middle of a bottom thereof and facing the upper half-cavity 111. Accordingly, an inside of the lower half-shell 12 protrudes upward to form a lower fastening frame 122 traversed in front of the lower half-cavity 121 with the semi-circular lower clipping fillister 123 opened in a middle of a top thereof and facing the lower half-cavity 121. The lower fastening frame 122 is mated with the upper fastening frame 112 to make the semi-circular lower clipping fillister 123 and the semi-circular upper clipping fillister 113 connected together to form the clipping fillister facing the receiving cavity 15. The rotating body 3 includes a pivoting portion 33 having a gradually increasing diameter from two ends to a middle along a axis thereof, and a connecting portion 31 extended from one end of the pivoting portion 33 along the axis of the pivoting portion 33. There is a perforation 32 opened to penetrate through the pivoting portion 33 and the connecting portion 31 along the axis of the rotating body 3.

Referring to FIG. 1, FIG. 2 and FIG. 3 again, when the power plug connector is to be assembled, the pin assembly 2 is fastened to the fastening body 5. One end of the wire 4 is passed through the perforation 32 of the rotating body 3 and then electrically connected with the pin assembly 2. Then the fastening body 5 is mounted in the front of the receiving chamber 10 of the shell 1 with the pin assembly 2 stretching forward beyond the shell 1, and the pivoting portion 33 of the rotating body 3 is pivoted in the receiving cavity 15 of the shell 1 with the connecting portion 31 stretching rearward beyond the shell 1 and the one end of the wire 4 being clipped in the semi-circular upper clipping fillister 113 and the semi-circular lower clipping fillister 123. Lastly, an ultrasonic welding technology is provided to tightly weld the upper half-shell 11 with the lower half-shell 12.

As described above, the rotating body 3 of the power plug connector according to the present invention can rotate in the receiving cavity 15 of the shell 1 so that can avoid the wire 4 twisting and fracturing in use and is further easy to arrange the wire 4 in order. Therefore, it prolongs the use life of the power plug connector.

What is claimed is:

1. A power plug connector for connecting with a wire, comprising:

a shell with a receiving cavity being opened through a rear end thereof;

a pin assembly fastened in a front of the shell and stretching forward beyond the shell; and a rotating body including a pivoting portion rotatably pivoted in the receiving cavity of the shell, the rotating body defining a perforation penetrating through the pivoting portion, one end of the wire being passed through the perforation of the rotating body and then electrically connected with the pin assembly.

2. The power plug connector as claimed in claim 1, wherein the receiving cavity is of substantially cylindrical shape with a gradually increasing diameter from two ends to a middle along a axis thereof, and the pivoting portion is of substantially columned shape with a gradually increasing diameter from two ends to a middle along a axis thereof, the perforation penetrates through the pivoting portion along the axis thereof.

3. The power plug connector as claimed in claim 1, wherein an inside of the shell defines a fastening frame traversed in front of the receiving cavity, the fastening frame defines a clipping fillister penetrating therethrough to face the receiving cavity for clipping the one end of the wire therein.

4. The power plug connector as claimed in claim 1, wherein the rotating body further includes a connecting portion extended from one end of the pivoting portion, the connecting portion stretches rearward out of the receiving cavity and beyond the shell, the perforation further penetrates through the connecting portion.

5. The power plug connector as claimed in claim 1, further comprising a fastening body mounted in the front of the shell, the pin assembly being fastened to the fastening body.

6. The power plug connector as claimed in claim 1, wherein the shell includes an upper half-shell and a lower half-shell engaged with each other, the receiving cavity includes an upper half-cavity opened through a rear end of the upper half-shell and a lower half-cavity opened through a rear end of the lower half-shell to mate with the upper half-cavity.

* * * * *